US007926279B2

(12) United States Patent
Wasif et al.

(10) Patent No.: US 7,926,279 B2
(45) Date of Patent: Apr. 19, 2011

(54) EXTENDED LIFE FUEL NOZZLE

(75) Inventors: Samer P. Wasif, Oviedo, FL (US); Robert J. Bland, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 923 days.

(21) Appl. No.: 11/524,740

(22) Filed: Sep. 21, 2006

(65) Prior Publication Data

US 2008/0072602 A1 Mar. 27, 2008

(51) Int. Cl.
*F02C 1/00* (2006.01)
*F02G 3/00* (2006.01)

(52) U.S. Cl. ..... 60/740; 60/742

(58) Field of Classification Search ..... 60/742, 60/740, 734, 746, 747, 39.463, 39.465
See application file for complete search history.

(56) References Cited

U.S. PATENT DOCUMENTS

| | | | | |
|---|---|---|---|---|
| 4,206,593 | A * | 6/1980 | Su et al. | 60/774 |
| 4,342,198 | A * | 8/1982 | Willis | 60/737 |
| 5,146,741 | A * | 9/1992 | Sood | 60/39.55 |
| 5,185,541 | A * | 2/1993 | Jensen | 310/11 |
| 5,255,508 | A * | 10/1993 | Davis | 60/800 |
| 5,329,761 | A | 7/1994 | Ablett et al. | |
| 5,572,862 | A | 11/1996 | Mowill | |
| 5,983,642 | A | 11/1999 | Parker et al. | |
| 6,109,038 | A | 8/2000 | Sharifi et al. | |
| 6,205,789 | B1 | 3/2001 | Patterson et al. | |
| 6,434,945 | B1 * | 8/2002 | Mandai et al. | 60/740 |
| 6,494,044 | B1 | 12/2002 | Bland | |
| 6,546,733 | B2 | 4/2003 | North et al. | |
| 6,547,163 | B1 * | 4/2003 | Mansour et al. | 239/404 |
| 6,557,350 | B2 | 5/2003 | Farmer et al. | |
| 6,735,950 | B1 | 5/2004 | Howell et al. | |
| 6,860,099 | B1 | 3/2005 | Xenofos et al. | |
| 6,871,501 | B2 | 3/2005 | Bibler et al. | |
| 7,007,477 | B2 | 3/2006 | Widener | |
| 2006/0191268 | A1 * | 8/2006 | Widener et al. | 60/772 |

* cited by examiner

*Primary Examiner* — Michael Cuff
*Assistant Examiner* — Andrew Nguyen

(57) ABSTRACT

A gas sleeve (120) for a combustor (408) of gas turbine engine (400) attaches to a support housing (100) of the combustor (408) to convey a fuel gas and to fit within a fuel rocket (110). The gas sleeve (120) comprises a plurality of apertures (128) formed to provide impingement cooling. The apertures (128) comprise a tilt angle directed toward a structure in need of impingement cooling, for instance a weld joint (114) that attaches the fuel rocket (110) to the support housing (100). The apertures (128) additionally may comprise a rotational angle effective to create a rotationally swirling flow of the portion of fuel gas that passes through the apertures (128). A method of operation using this structure also is provided.

13 Claims, 3 Drawing Sheets

EXTENDED LIFE FUEL NOZZLE

FIELD OF THE INVENTION

This invention relates to a combustion products generator, such as a gas turbine, and more particularly to a combustor for a combustion products generator that comprises a fuel gas sleeve adapted to provide a cooling flow of gas fuel to a surrounding fuel rocket attached to a combustor support housing.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor.

Heat generated from the combustion process, which takes place in a combustion chamber of a combustor, may shorten component life of various components exposed to that heat. This may occur particularly in situations in which a first component is attached to a second component whose temperature is substantially lower than that of the first component. A range of alternatives have been developed to maintain an acceptable component life for various components. These include making the components with an alloy that provides greater inherent heat stability, providing thermal barrier coatings (such as ceramic coatings), providing structural barriers, providing closed cooling systems that pass within a respective component, and providing open cooling systems.

As combustors of gas turbine engines are redesigned, such as to improve performance and reliability and to introduce new approaches toward such goals, certain design changes may result in a decreased component life for certain components. This may be due to changes in cooling that are introduced by design changes made for other reasons. To obtain a desired component life for all components of a newly designed combustor, appropriate innovations are required, and these may be conceived and achieved on a component by component basis, depending on particular circumstances.

In the present situation, a need was recognized for providing a new form of cooling using a defined flow of fuel gas.

BRIEF DESCRIPTION OF THE DRAWINGS

FIG. 3A provides a cross-sectional view of a section of a gas sleeve. FIG. 3B provides a cross-sectional view of one of the holes of FIG. 3A taken along the section 3B-3B.

DETAILED DESCRIPTION OF EMBODIMENTS OF THE INVENTION

Embodiments of the present invention solve a cooling problem created by a specific redesign of a combustor for a gas turbine engine. As part of this redesign process, a base of a fuel rocket component of the combustor was widened. In part this design change afforded greater structural stability to support a fuel swirler that was to be attached at its free or distal end. The wider fuel rocket also provided sufficient space for coiling a fuel oil tube to address thermal expansion of that fuel supply tube. Within the bore of the coiling a gas sleeve was provided for provision of a fuel gas to a point downstream, on a flow basis, of most or all of the coiling.

The inventors of the present invention realized, however, that at the base of the fuel rocket there would be a zone having a high thermal gradient given that this is where a cooler support housing joins a substantially hotter fuel rocket structure. Also, a weld along the relatively wider rocket base, which is expected to be weaker than the fuel rocket itself, would not be cooled in a manner that the earlier versions were cooled, e.g., merely by the flow of fuel gas within a narrower fuel rocket. Consequently, the base area and the weld, which attaches the wider rocket base to the combustor support housing, would be subject to higher temperatures that would unacceptably shorten the life of the weld. The inventors conceived of an innovative solution to cool this weld without the use of a separate cooling air flow from fluid compressed by the turbine compressor, and without use of other performance- or efficiency-decreasing approaches. This was achieved by providing active cooling using a portion of the fuel gas flowing into the gas sleeve.

Figure 1:
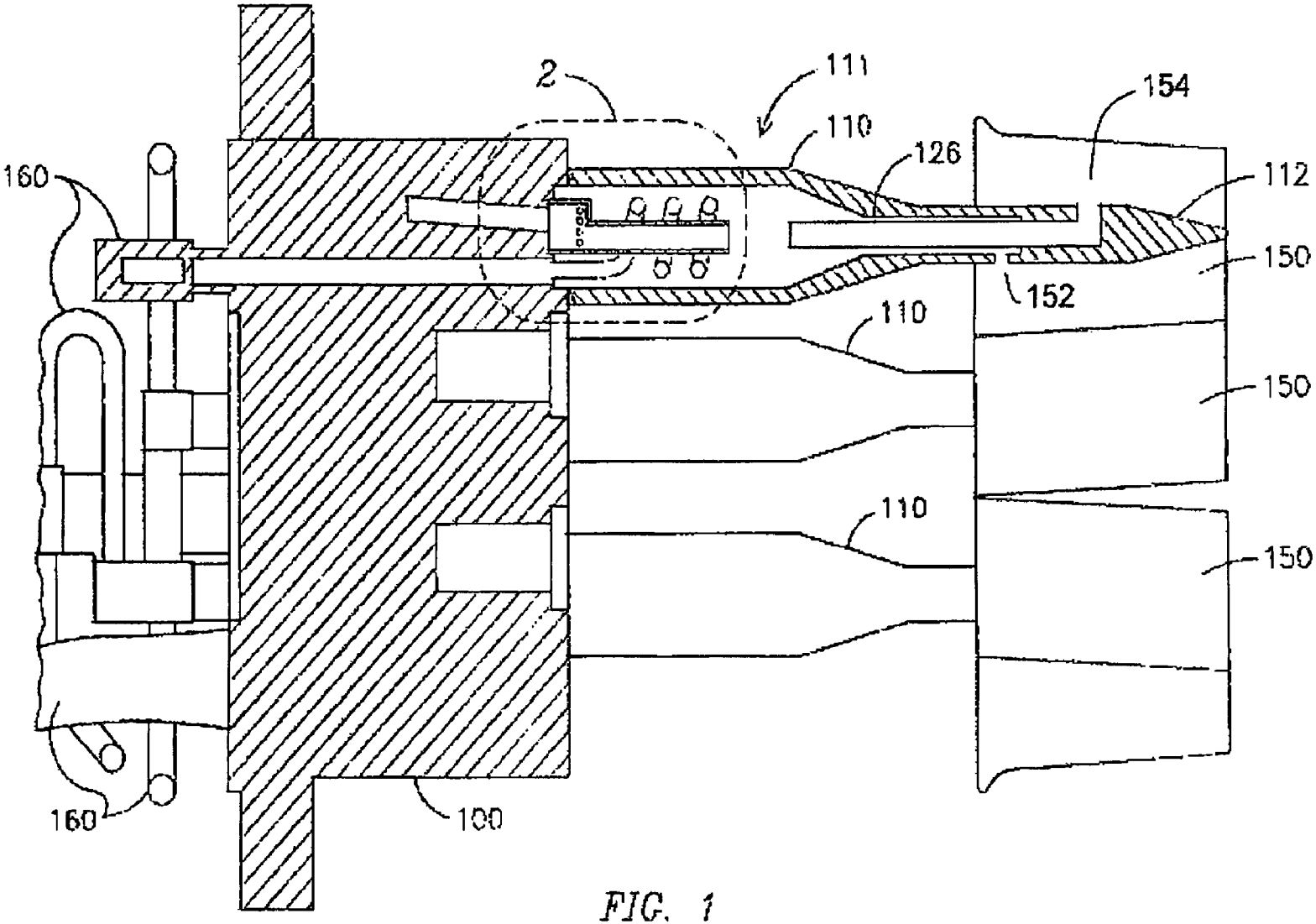
FIG. 1 is a side, partial cross-sectional view of a portion of a combustor for a gas turbine engine that depicts one embodiment of the invention.

FIG. 1 provides a depiction of an exemplary embodiment of the invention, which is not meant to be limiting. This figure presents a side, partial cross-sectional view of a portion of a combustor for a gas turbine engine. As depicted, a combustor support housing 100 supports three fuel rockets 110, one of which is cut through the plane of the cross section to reveal inner components. Toward its distal end 112 each of the fuel rockets 110 is attached to and generally supports a respective swirler 150. Generally, during operation one of two fuels, gas or oil, is supplied by respective supply lines, generally shown as 160, leading into the support housing 100. The respective fuel passes through the support housing 100, then through fuel rockets 110 and into the swirlers 150 to mix with compressed oxygen-containing fluid also passing through the swirlers 150. Each respective fuel is fed through the fuel rocket 110 separately and is discharged through separate outlets 152, 154 of the swirler 150. Combustion takes place in a combustion zone that is downstream, on a flow basis, of the swirlers 150. The fuel rocket 110 and components within it between the support housing and the swirler 150 may be considered to comprise a fuel rocket assembly 111.

Figure 2:
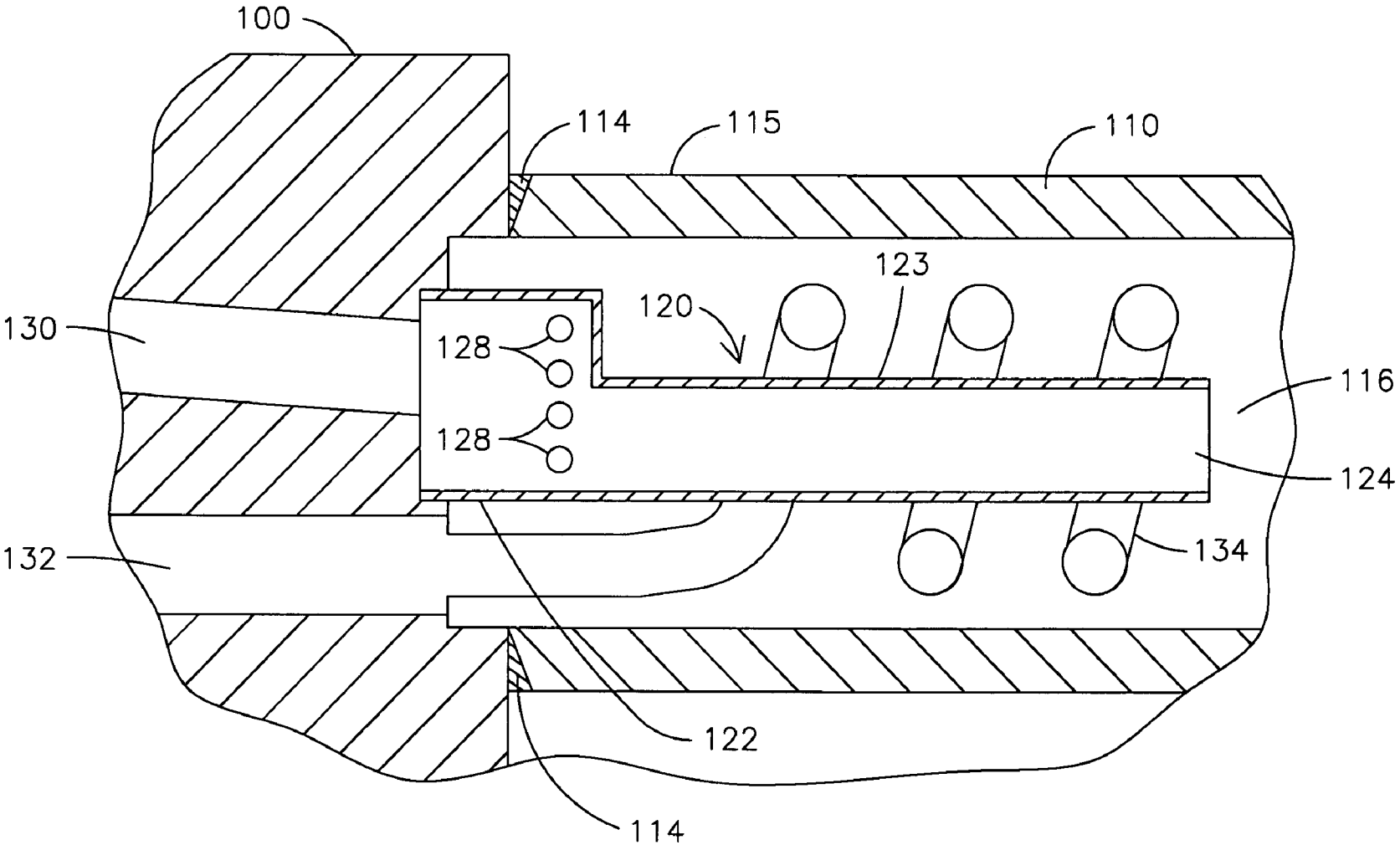
FIG. 2 is an enlarged view of a portion of FIG. 1 that is surrounded by dashed lines.

FIG. 2 provides an enlarged view of the portion of FIG. 1 that is surrounded by dashed lines. A rocket weld 114 attaches fuel rocket 110 to support housing 100 along a base 115 of the fuel rocket 110. A gas sleeve 120, positioned within the fuel rocket 110, is in fluid communication with a fuel gas inlet 130 for passing fuel gas through a lumen 116 within the fuel rocket 110. A gas sleeve inlet 122 is a base portion of the gas sleeve 120 attaching to the support housing 100, and in this embodiment being wider than the more downstream remainder of the gas sleeve 120. A fuel oil inlet 132, extending through the support housing 100, communicates with a coiled oil tube 134 that surrounds a narrower, more distal portion 123 of the gas sleeve 120. A fuel gas outlet 124 is provided at the most distal end of the gas sleeve 120. During operation fuel that exits the fuel gas outlet 124 passes through a narrow passage (126 in FIG. 1) surrounding a straight oil tube section 136 and then to outlets (not shown) in the swirler 150 (see FIG. 1).

To cool the rocket weld 114 during gas fuel operation, a plurality of impingement holes 128 are provided through the gas sleeve inlet 122. In the embodiment depicted in FIG. 1, each of the impingement holes 128 is angled both to direct a flow of fuel gas at the rocket weld 114 (and, more generally at adjacent areas of the rocket base 115 and the support housing 100), and also to provide a swirling pattern circumferentially about an axis defined by the length of the fuel rocket 110 from its base 115 to its distal end 112. This flow pattern, developed due to the provision of a compound angle for each of the impingement holes 128, is described below in relation to FIGS. 3A and 3B. After cooling the rocket weld 114, and adjacent areas, the fuel gas flows through the narrow passage 126, mixing with fuel gas that passes, more directly, through the fuel gas outlet 124.

Generally it is appreciated that during operation of some embodiments a support housing will have a substantially lower temperature than a base area of a fuel rocket attached to it, where that fuel rocket base area is not provided with active cooling by use of a flow of fuel gas from the fuel system within the fuel rocket. Whereas in embodiments in which the base area is welded to the support housing, given that such welds are less strong than the fuel rocket itself with regard to tolerating thermal stresses, the active cooling described herein, when directed to the base area, is effective to maintain the weld at a cooler temperature, closer to the temperature of the support housing. The active cooling also is effective to move the area of high relative stress, which is due to a large temperature gradient, further from the base, toward the distal end of the fuel rocket, where the fuel rocket structure better tolerates this stress.

Figure 3A:
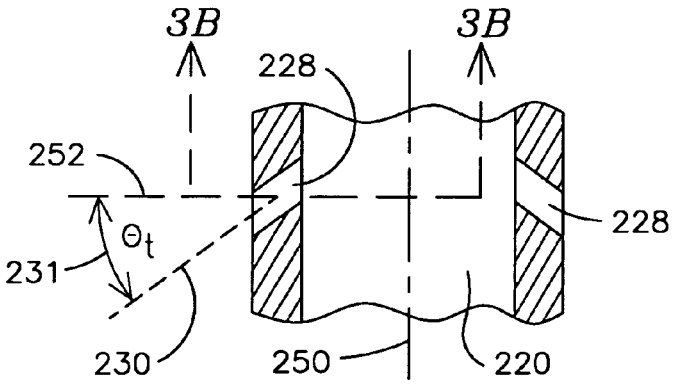
FIGS. 3A and 3B depict compound angle characteristics of impingement holes as are found in embodiments of the invention.
Figure 3B:
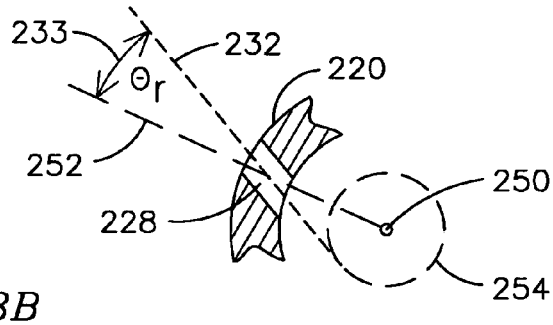

FIGS. 3A and 3B are provided to further describe the compound angle characteristics of impingement holes such as impingement holes 128 in FIG. 2. FIG. 3A provides a cross-sectional view of a section of a gas sleeve 220 that bisects the gas sleeve 220 to reveal two holes 228 each placed with a compound angle effective to target a desired area to cool and to create a swirling pattern. A central axis 250 of the gas sleeve 220 also is depicted. FIG. 3B provides a cross-sectional view of one of the holes 228 of FIG. 3A taken along the section 3B-3B. Viewing FIG. 3A, it is observed that hole 228 has a compound angle defined in part by an angle of tilt 231 ($\theta_t$) shown as the angle between a perpendicular line 252 from the axis 250 and a line 230 representing the effective rearward tilting angle of hole 228 (wherein rearward is assessed in view of direction of flow in FIGS. 1 and 2). Viewing FIG. 3B, it is observed that the same hole 228 of FIG. 3A has a second component of its compound angle defined in part by an angle of rotation 233 ($\theta_r$) shown as the angle between the perpendicular line 252 from the axis 250 and a line 232 representing the effective rotational tilting angle of hole 228. The rotation of line 232 results in it being tangential to an imaginary cylinder 254 having axis 250 as its center.

Accordingly, embodiments of the invention provide a plurality of impingement holes, or more generally apertures, in a gas sleeve wherein the impingement holes have compound angles effective to actively cool a desired area of surrounding structure, such as a rocket base, with a rotationally swirling flow of cooling fuel gas. For specific embodiments, a desired compound angle to achieve active cooling to a desired area, and simultaneously to provide a desired angle of rotational swirling, may be calculated and drilled or otherwise formed into a gas sleeve by means known to those skilled in the art.

During typical operations, a small portion, less than half, or substantially less than half, of the total supplied fuel gas passes through impingement holes 128 or 228. This portion of gas heats up by cooling the rocket weld 114, and thereby increases the average fuel gas temperature.

The embodiment depicted in FIGS. 1 and 2 is not meant to be limiting. For example, instead of a fuel gas and fuel oil dual fuel combustor, embodiments may be provided with only fuel gas supply. Some such embodiments would appear like FIGS. 1 and 2, only without the fuel oil inlet 132, coiled oil tube 134, straight oil tube section 136 and associated downstream outlets. In one such embodiment the gas sleeve inlet is placed more centrally (since there is no adjacent oil tube) within the space defined by the rocket base 115.

Also, the relative positions of the apertures and the area to be cooled by the portion of fuel gas passing through the apertures is not meant to be limited to the relative positions depicted in FIGS. 1 and 2. In some embodiments, there may be no 'backward' or 'reverse' tilt angle from the apertures to the area to be cooled. That is, the apertures may be co-planar with the area to be cooled (having zero tilt angle), or may be more upstream on a flow-based directionality (i.e., have a forward tilt angle). Similarly, various embodiments may be provided wherein the apertures do not have an angle of rotation (i.e., $\theta_r$=0).

More generally, it is appreciated that a gas sleeve for providing fuel gas to a burner, which may be disposed within a fuel rocket assembly of a gas turbine engine combustor, comprises a plurality of apertures to provide impingement-type cooling of a desired area, structure, or component, such as a critical weld joint, wherein the impingement-type cooling is effective to extend the life of such areas, structures or components.

With regard to the use of the terms "hole" and "aperture," it is appreciated that a hole is but one type of aperture that may be used in embodiments of the present invention. As used herein, the term aperture is taken to mean any defined opening through a body, including but not limited to a round hole, an elliptical hole, a conical hole, a slit, or otherwise shaped passage through the body for the purpose of directing a fluid to cool a surface of a structure or component.

Embodiments of the present invention include specific individual components, such as a gas sleeve as set forth herein, a fuel rocket assembly or rebuild kit comprising such gas sleeve, a combustor (which may include a plurality of fuel rocket assemblies configured on a support housing), and a gas turbine engine comprising such gas sleeve in each of one or more fuel rocket assemblies in combustors.

Figure 4:
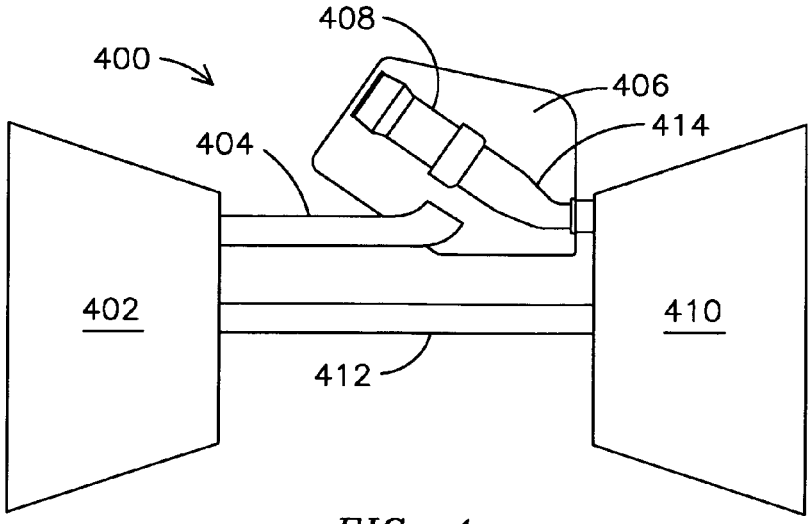
FIG. 4 is a schematic cross-sectional depiction of a gas turbine engine that may comprise various embodiments of the invention.

FIG. 4 provides a schematic cross-sectional depiction of a gas turbine engine 400 that may comprise various embodiments of the present invention. The gas turbine engine 400 comprises a compressor 402, a combustor 408 (such as a can-annular combustor), and a turbine 410. During operation, in axial flow series, compressor 402 takes in air and provides compressed air to a diffuser 404, which passes the compressed air to a plenum 406 through which the compressed air passes to the combustor 408, which mixes the compressed air with fuel (not shown, see FIGS. 1 and 2), providing combusted gases via a transition 414 to the turbine 410, which may generate electricity. A shaft 412 is shown connecting the turbine to drive the compressor 402. Although depicted schematically as a single longitudinal channel, the diffuser 404 extends annularly about the shaft 412 in typical gas turbine engines, as does the plenum 406.

Based on the above disclosure and appended figures, it is further appreciated that embodiments of the present invention also pertain to methods for cooling a desired area or structure of a fuel rocket assembly of a gas turbine engine combustor. One such method may be described as follows:

1. forming a plurality of apertures through a gas sleeve to provide impingement cooling, the forming comprising providing a tilt angle of the apertures directed toward an area or a structure in need of impingement cooling;

2. attaching the gas sleeve to a support housing to convey a fuel gas;

3. attaching a fuel rocket onto the support housing to enclose the gas sleeve; and, 4. supplying a flow of the fuel gas through the gas sleeve from the support housing, wherein a portion of the flow passing through the apertures is effective for cooling the desired area or structure of the fuel rocket assembly.

Another related method for cooling a desired area of a fuel rocket assembly of a gas turbine engine combustor may be described as follows: directing a portion of fuel gas to be consumed in the combustor through a plurality of apertures to impinge the area to be cooled by said portion prior to said portion being consumed, wherein the plurality of apertures are formed through a gas sleeve at angles to direct said portion to the area, the gas sleeve attached to the support housing to convey a fuel gas and fitting within the fuel rocket.

In various embodiments, the desired area of the fuel rocket assembly includes a weld attaching the base of the fuel rocket to the support housing. Also, per the above discussion, the forming step noted above may also comprise additionally providing a rotational angle effective to create a rotationally swirling flow of cooling fuel gas from the apertures.

It should be understood that the examples and embodiments described herein are for illustrative purposes only and that various modifications or changes in light thereof will be suggested to persons skilled in the art and are to be included within the spirit and purview of this application and the scope of the appended claims.

The invention claimed is:

1. A fuel injector assembly for a gas turbine engine combustor comprising a support housing configured to support a plurality of fuel injector assemblies, the fuel injector assembly comprising:

a fuel injector comprising a base end adapted to attach to a combustor support housing and a distal end adapted for attachment to a swirler assembly, a fuel injector inner surface defining an outer boundary of a first fluid communication path from the base end to first fuel injector outlets disposed through the distal end; and a gas sleeve adapted to attach at a gas sleeve upstream end to the support housing and provide a second fluid communication path configured to convey a fuel gas from a fuel gas supply disposed in the support housing to the first fluid communication path, the gas sleeve fitting within the fuel injector and comprising a plurality of apertures proximate the gas sleeve upstream end formed to provide impingement cooling of the fuel injector base end, and a gas sleeve downstream aperture to provide fuel gas to the injector downstream of the plurality of apertures.

2. The fuel injector assembly of claim 1, additionally comprising a coiled oil tube that surrounds a distal portion of the gas sleeve, the coiled oil tube in fluid communication with the support housing to receive a supply of fuel oil and deliver the supply of fuel oil to a second injector outlet disposed through the distal end.

3. The fuel injector assembly of claim 1, the apertures comprising an angle with a tangential component effective to create an axial and circumferential flow of cooling fuel gas from the apertures.

4. The fuel injector assembly of claim 1, the apertures comprising an angle comprising an axial component directed toward the area comprising the fuel injector base end.

5. The fuel injector assembly of claim 4, wherein the area comprising the fuel injector base end toward which the apertures are directed comprises a weld joint joining the fuel injector base to the support housing.

6. The fuel injector assembly of claim 5, the apertures additionally comprising an angle with a tangential component effective to create an axial and circumferential flow of cooling fuel gas from the apertures.

7. The fuel injector assembly of claim 6, the gas sleeve comprising a gas sleeve inlet portion wider than the remainder of the gas sleeve, wherein the gas sleeve inlet portion comprises the apertures.

8. A combustor for a gas turbine engine comprising the fuel injector assembly of claim 1.

9. A gas turbine engine comprising the combustor of claim 8.

10. A combustor for a gas turbine engine comprising the fuel injector assembly of claim 6.

11. A method for cooling a desired area of a fuel injector assembly of a gas turbine engine combustor comprising a support housing configured to support a plurality of fuel injector assemblies, the method comprising:

directing a first portion of fuel gas to be consumed in the combustor into a fuel injector through a plurality of apertures in a gas sleeve proximate a gas sleeve upstream end to impinge an area comprising an upstream base end of the fuel injector to be cooled by said first portion prior to said first portion being consumed, wherein the plurality of apertures comprise angles comprising axial components to direct said first portion to the area comprising the upstream base end of the fuel injector, wherein the gas sleeve is adapted to be attached to the support housing at the gas sleeve upstream end and in fluid communication with a supply of fuel gas disposed in the support housing, and wherein the gas sleeve fits within the fuel injector; and directing a second portion of fuel gas to be consumed in the combustor through the gas sleeve and into the fuel injector via a sleeve downstream aperture disposed downstream of the plurality of apertures, wherein the first portion of fuel gas and second portion of fuel gas enter an injector fuel gas path defined by an interior surface of the fuel injector, and wherein the injector fuel gas path delivers the first portion of fuel gas and second portion of fuel gas to the combustor through first injector openings disposed through a downstream end of the fuel injector.

12. The method of claim 11, wherein the area comprising the upstream base end of the fuel injector comprises a weld joint attaching the fuel injector to the support housing, and the directing is through apertures formed at angles such that the weld joint attaching the fuel injector to the support housing is cooled by the impinging fuel gas.

13. The method of claim 11, wherein the directing is through apertures formed at angles comprising an axial component directed toward the area to be cooled, and an angle with a tangential component effective to create an axial and circumferential flow of cooling fuel gas from the apertures.

* * * * *